United States Patent [19]

Lipp et al.

[11] 4,225,844

[45] Sep. 30, 1980

[54] ADJUSTABLE VARIABLE RESISTANCE CONTROL SYSTEM

[75] Inventors: Ellis P. Lipp; Mark L. Petre, both of Frankfort, Ind.

[73] Assignee: Emhart Industries, Inc., Indianapolis, Ind.

[21] Appl. No.: 8,276

[22] Filed: Feb. 1, 1979

[51] Int. Cl.[3] ..... H01C 10/00

[52] U.S. Cl. ..... 338/135; 338/132; 338/174

[58] Field of Search ..... 338/131, 128, 130, 132, 338/135, 174

[56] References Cited

U.S. PATENT DOCUMENTS

| | | | |
|---|---|---|---|
| 3,771,093 | 11/1973 | Ishikawa et al. | 338/132 |
| 4,035,758 | 7/1977 | Panke | 338/132 |

*Primary Examiner*—C. L. Albritton

*Attorney, Agent, or Firm*—Hoffmann & Meyer

[57] ABSTRACT

A first rotor is fixedly carried by a shaft and a second rotor is loosely carried by the shaft. A coupling means couples the second rotor to the shaft through flanges extending from the rotor and pinching the shaft. The two rotors are then adjusted with respect to one another by rotating the shaft while holding the second rotor in place.

5 Claims, 3 Drawing Figures

ADJUSTABLE VARIABLE RESISTANCE CONTROL SYSTEM

BACKGROUND OF THE INVENTION

This invention relates to variable resistance control systems and more particularly to such control system wherein one rotor of a variable resistance control needs to be adjusted with respect to a rotor of another variable resistance control.

Variable resistance control systems are widely used in appliances such as radios, televisions and stereos. In stereos, the control systems are used to regulate, among other things, the volume of the sound output of the speakers by regulating the resistance in the electrical circuit of the speakers. In such applications, when one of the speakers is changed, the other(s) speaker is changed accordingly. To this end, it is imperative that the rotor, which carries the electrical contacts to bridge the resistance and collector paths, be predeterminatively set with respect to the other(s) rotors of the system.

OBJECTS OR FEATURES OF THE INVENTION

Accordingly, it is a feature of the present invention to provide a variable resistance control system that is especially useful in stereos. Another feature of the invention is the provision of such a system wherein a rotor of one control is adjustable with respect to another. Another feature of the invention is to provide such a control system wherein two rotors are carried on the same shaft one of the rotors being fixedly carried, the other being loosely carried but coupled to the shaft through a means extending from the rotor and pinching the shaft. Still another feature of the invention is the provision of such a control system wherein the pinching is provided by flanges extending from the rotor. Yet still another feature of the invention is the provision of a method of adjusting one rotor with respect to the other. Another feature of the invention is the provision of such a method wherein one rotor is fixedly carried on a shaft, the other loosely carried but coupled to the shaft, the shaft being rotated while the loosely carried rotor is held in a fixed position. These and other features of the invention will become apparent from the following description taken in conjunction with the accompanying drawings.

DETAILED DESCRIPTION OF THE INVENTION

Figure 1:
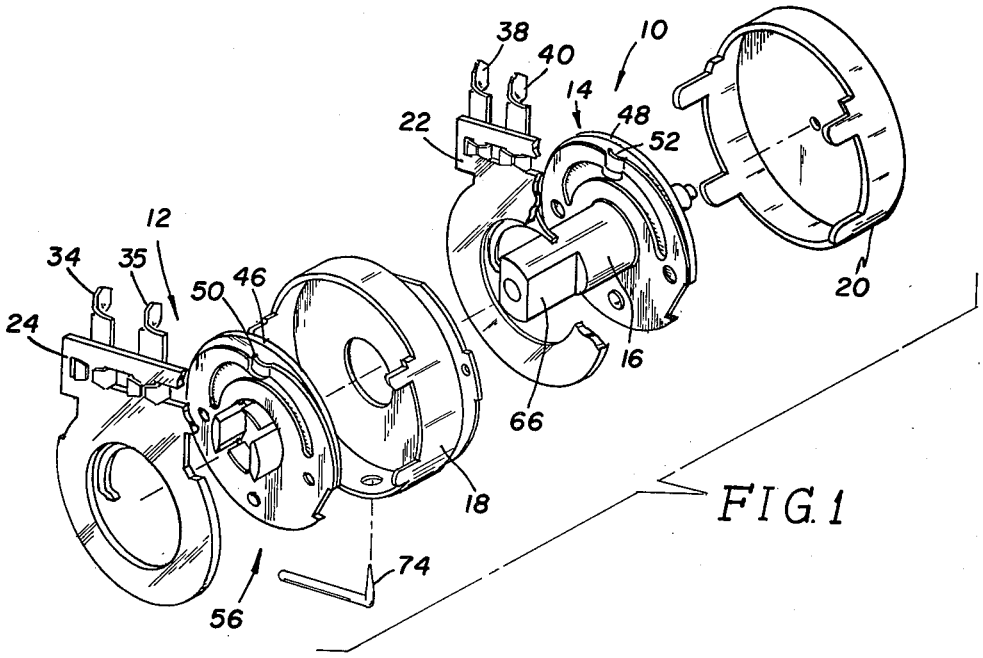
FIG. 1 is an exploded view of a control system.
Figure 2:
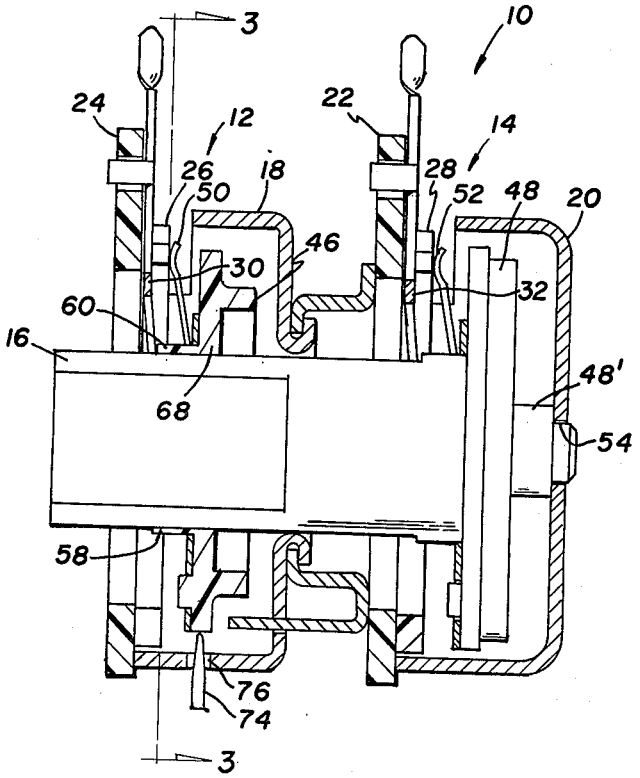
FIG. 2 is a section taken in elevation of the control system.
Figure 3:
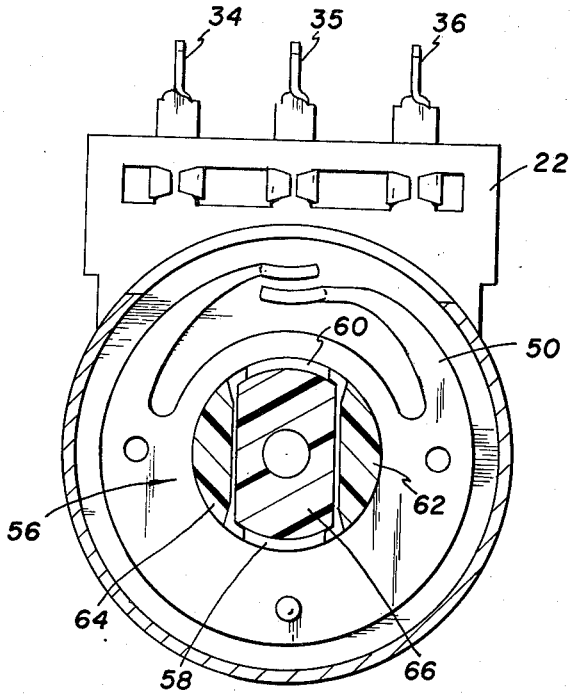
FIG. 3 is a section taken along the line 3—3 of FIG. 2.

Referring to the drawings, control system 10, in general, includes two variable resistance control units 12 and 14 each carried by a shaft 16. In general, each variable resistor includes a cup shaped housing member 18 and 20 closed by a terminal board 22 and 24. Resistance paths 26 and 28 and collector paths 30 and 32 are carried by the terminal boards and are electrically connected to electrical terminals 34, 35, 36, 38, and 40, (36 in FIG. 3). Rotors 46 and 48 are carried by shaft 16 and carry electrical contact arms 50 and 52 which engage the resistance paths and the collector paths to electrically bridge the same as the rotors are rotated.

Rotor 48 is fixedly carried on shaft 16 and includes a hub portion 48' which is rotatably journalled in aperture 54.

Rotor 46 is coupled to shaft 16 through coupling means 56 such that the rotor can be both rotatable with or independently of the shaft. Coupling means 56 includes a plurality of flanges 58, 60, 62 and 64 extending from hub 68 and which are shaped to mate and pinch the double-D portion 66 of the shaft. As viewed in FIG. 3, a relatively large clearance is illustrated, for purpose of clarity, between the shaft and flanges 62 and 64. In practice, there is a close fit between them, the amount of clearance being dictated by the amount of adjustment normally required with as little loss of torque as possible; that is, the torque required to turn the electrical contacts over the resistance and collector paths. Thus, flanges 62 and 64 also provide a stop means to limit the amount of adjustment which can be made. For example, the clearance between the flanges and the shaft would be set to give an adjustment of $\pm 3°$.

With the described arrangement of rotor 46, rotor 48 can be adjusted with respect to rotor 46 by holding rotor 46 in place while turning shaft 16. In the illustrative embodiment, rotor 46 is held by inserting a suitable tool such as a stylus 74 through aperture 76 to engage the rotor and hold it. Holding the rotor while rotating the shaft permits the shaft to slip between the flanges while rotor 48 is being rotated to be adjusted with respect to rotor 46. After the rotors have been adjusted, the pinching of the flanges on the shaft will insure normal operation of the rotor when shaft 16 is turned.

With the rotors being adjusted with respect to each other, the relative position of contact arms 50 and 52 are set according to predetermined positions so as to maintain a predetermined relationship of the resistance of one control unit with respect to the other.

The operation of the variable resistance control units are the same as that known in the art, once the rotors have been adjusted. Rotation of shaft 16 causes rotation of rotor 46 and 48 to vary the resistance of the units as the contact arms 50 and 52 pass over their respective resistance and collector paths.

What is claimed is:

1. In a variable resistor wherein a pair of rotors, each carrying electrical contact means, rotate while the electrical contact means engages separate resistance and collector paths, an adjustment means permitting adjustment of one rotor with respect to the other comprising:

(a) a first rotor fixedly carried on shaft for rotation therewith, (b) coupling means coupled to a second rotor to said shaft for rotation therewith comprising means extending from said second rotor and pinching said shaft, and (c) means permitting said second rotor to be held against rotation while rotating said first rotor.

2. In a variable resistor according to claim 1 wherein said means extending from said second rotor are flanges extending from a hub of said second rotor.

3. In a variable resistor according to claim 2 further including stop means limiting the amount of rotation of said first rotor.

4. In a variable resistor according to claim 3 wherein said stop means includes predetermined spacing between said flanges.

5. In a variable resistor according to claim 1 wherein said means permitting said second rotor to be held includes a hole in said rotor receiving a stylus.

* * * * *